US007216865B2

(12) United States Patent
Tamura et al.

(10) Patent No.: US 7,216,865 B2
(45) Date of Patent: May 15, 2007

(54) SHEET CONVEYING DEVICE FOR AN IMAGE FORMING APPARATUS

(75) Inventors: Masahiro Tamura, Tokyo (JP); Nobuyoshi Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 10/927,240

(22) Filed: Aug. 27, 2004

(65) Prior Publication Data

US 2005/0082747 A1 Apr. 21, 2005

(30) Foreign Application Priority Data

Aug. 29, 2003 (JP) ..... 2003-307580

(51) Int. Cl.
*B65H 29/20* (2006.01)

(52) U.S. Cl. ..... 271/207; 271/213; 414/791.2

(58) Field of Classification Search ..... 271/184, 271/207, 213, 298, 303; 414/791.2
See application file for complete search history.

(56) References Cited

U.S. PATENT DOCUMENTS

| | | | | |
|---|---|---|---|---|
| 4,955,597 | A * | 9/1990 | Johdai et al. | 271/215 |
| 5,478,061 | A * | 12/1995 | Murakami et al. | 270/58.08 |
| 5,692,411 | A | 12/1997 | Tamura | |
| 6,145,825 | A | 11/2000 | Kunihiro et al. | |
| 6,199,853 | B1 | 3/2001 | Andoh et al. | |
| 6,264,191 | B1 | 7/2001 | Suzuki et al. | |
| 6,296,247 | B1 | 10/2001 | Tamura et al. | |
| 6,394,448 | B2 | 5/2002 | Suzuki et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,572,105 | B2 * | 6/2003 | Baker et al. | 271/303 |
| 6,644,655 | B2 * | 11/2003 | Wurschum | 271/225 |
| 6,698,744 | B2 | 3/2004 | Yamada et al. | |
| 6,988,729 | B2 * | 1/2006 | Tamura et al. | 271/303 |
| 2005/0082747 | A1 | 4/2005 | Tamura et al. | |

OTHER PUBLICATIONS

U.S. Appl. No. 10/640,044, filed Aug. 14, 2003, Suzuki et al.
U.S. Appl. No. 10/629,654, filed Jul. 30, 2003, Yamada et al.
U.S. Appl. No. 10/443,028, filed May 22, 2003, Tamura et al.
U.S. Appl. No. 10/339,304, filed Jan. 10, 2003, Suzuki et al.
U.S. Appl. No. 10/395,053, filed Mar. 25, 2003, Yamada et al.

(Continued)

*Primary Examiner*—Patrick Mackey
*Assistant Examiner*—Kaitlin Joerger
(74) *Attorney, Agent, or Firm*—Oblon, Spivak, McClelland, Maier & Neustadt, P.C.

(57) ABSTRACT

A sheet conveying device of the present invention includes a conveying member for conveying a sheet, a switching mechanism for switching the direction of conveyance of the sheet being conveyed by the sheet conveying member, and a shifting mechanism for shifting the sheet passed through the switching mechanism and nipped by the conveying member in a direction perpendicular to the direction of conveyance. The switching mechanism and shifting mechanism share a single drive source.

43 Claims, 14 Drawing Sheets

OTHER PUBLICATIONS

U.S. Appl. No. 10/361,762, filed Feb. 11, 2003, Yamada et al.
U.S. Appl. No. 10/385,489, filed Mar. 12, 2003, Tamura et al.
U.S. Appl. No. 10/279,845, filed Oct. 25, 2002, Tamura et al.
U.S. Appl. No. 10/253,652, filed Sep. 25, 2002, Yamada et al.
U.S. Appl. No. 10/172,910, filed Jun. 18, 2002, Tamura et al.
U.S. Appl. No. 10/101,741, filed Mar. 21, 2002, Suzuki et al.
U.S. Appl. No. 10/109,992, filed Apr. 1, 2002, Nagasako et al.
U.S. Appl. No. 10/015,634, filed Dec. 17, 2001, Tamura et al.
U.S. Appl. No. 09/997,304, filed Nov. 30, 2001, Tamura et al.
U.S. Appl. No. 11/223,052, Sep. 12, 2005, Suzuki et al.
U.S. Appl. No. 11/254,868, Oct. 21, 2005, Suzuki et al.
U.S. Appl. No. 11/267,403, Nov. 7, 2005, Tokita et al.
U.S. Appl. No. 11/273,301, Nov. 15, 2005, Iida et al.

* cited by examiner

SHEET CONVEYING DEVICE FOR AN IMAGE FORMING APPARATUS

BACKGROUND OF THE INVENTION

1. Field of the Invention

The present invention relates to a sheet conveying device and more particularly to a sheet conveying device including a unique mechanism for switching a sheet conveying path, a sheet processing apparatus including the sheet conveying device, an image forming apparatus including the sheet processing apparatus, an image forming system including the sheet processing apparatus, a computer program for controlling the sheet conveying device or the sheet processing apparatus, a computer program for executing a sheet processing method with a computer, a recording medium storing such a computer program such that a computer can read it out, and a sheet processing method.

2. Description of the Background Art

Japanese Patent Laid-Open Publication Nos. 7-315668 and 2000-53302, for example, each disclose a sheet conveying device in which path selectors are positioned in parallel in a direction of sheet conveyance. This configuration minimizes the widthwise dimension of the path selectors for thereby reducing the overall size of the sheet conveying device.

Particularly, in the sheet conveying device taught in the above Laid-Open Publication No. 7-315668, two path selectors do not pivot independently of each other, but pivot at the same time as each other. Such path selectors, however, occupy a great exclusive area when pivoting and cannot pivot at the same time unless use is made of solenoids having great power.

On the other hand, the sheet conveying device taught in Laid-Open Publication No. 2000-53302 includes path selectors respectively positioned at a first and a second branch portion and interconnected by a first, a second and a third link member and solenoids that control the links to switch a sheet path. Further, a third path selector is positioned at the second branch portion and driven independently of the second path selector about its own fulcrum. This configuration has a problem that when the edge of the upper path selector contacts the upper surface of the lower path selector when selecting an upward path, the above edge and the edge of the lower path selector are apart from each other by a great distance. As a result, it is likely that the leading edge of a sheet being conveyed abuts against the upper surface of the lower path selector and is steed downward thereby instead of being steered upward by the edge portion of the upper path selector, resulting in a jam.

As stated above, arranging path selectors in parallel is one of effective implementations for reducing the overall size of a sheet processing apparatus. However, a problem with the conventional technologies is that a particular solenoid or drive source must be assigned to each of two path selectors arranged in parallel and rotatable independently of each other, increasing the cost of the sheet processing apparatus. Moreover, the solenoids each being assigned to a particular path selector obstruct the reduction of the size, particularly width, of the sheet processing apparatus.

SUMMARY OF THE INVENTION

It is an object of the present invention to provide a sheet conveying device, a sheet processing apparatus and an image forming apparatus each being small size and low cost.

It is another object of the present invention to provide a sheet conveying device, a sheet processing apparatus and an image forming apparatus each being capable of surely effecting, e.g., three-way or similar sheet conveyance control and shift control even when reduced in size and cost.

In accordance with the present invention, a sheet conveying device includes a conveying member for conveying a sheet, a switching mechanism for switching the direction of conveyance of the sheet being conveyed by the sheet conveying member, and a shifting mechanism for shifting the sheet passed through the switching mechanism and nipped by the conveying member in a direction perpendicular to the direction of conveyance. The switching mechanism and shifting mechanism share a single drive source.

A sheet processing apparatus, an image forming apparatus and an image forming system each using the above sheet conveying device are also disclosed.

Further, in accordance with the present invention, a sheet processing method capable of dealing with a shift mode, a staple mode and a proof mode begins with the step of determining which of the shift mode, staple mode and proof mode is selected. If the shift mode is selected, a motor configured to move a shift roller pair in a direction perpendicular to the direction of sheet conveyance is rotated by a preselected amount when the shift roller pair is conveying a sheet in a preselected direction. Further, if the staple mode is selected, the motor is rotated in a direction opposite to the preselected direction for thereby actuating a switching mechanism configured to switch a path selector to a position for steering a sheet to a path that extends to a staple tray. On the other hand, if the proof mode is selected, the motor is rotated in the direction opposite to the preselected direction for thereby actuating the switching mechanism configured to switch the path selector to a position for steering a sheet to a path that extends to a proof tray.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENT

Figure 1:
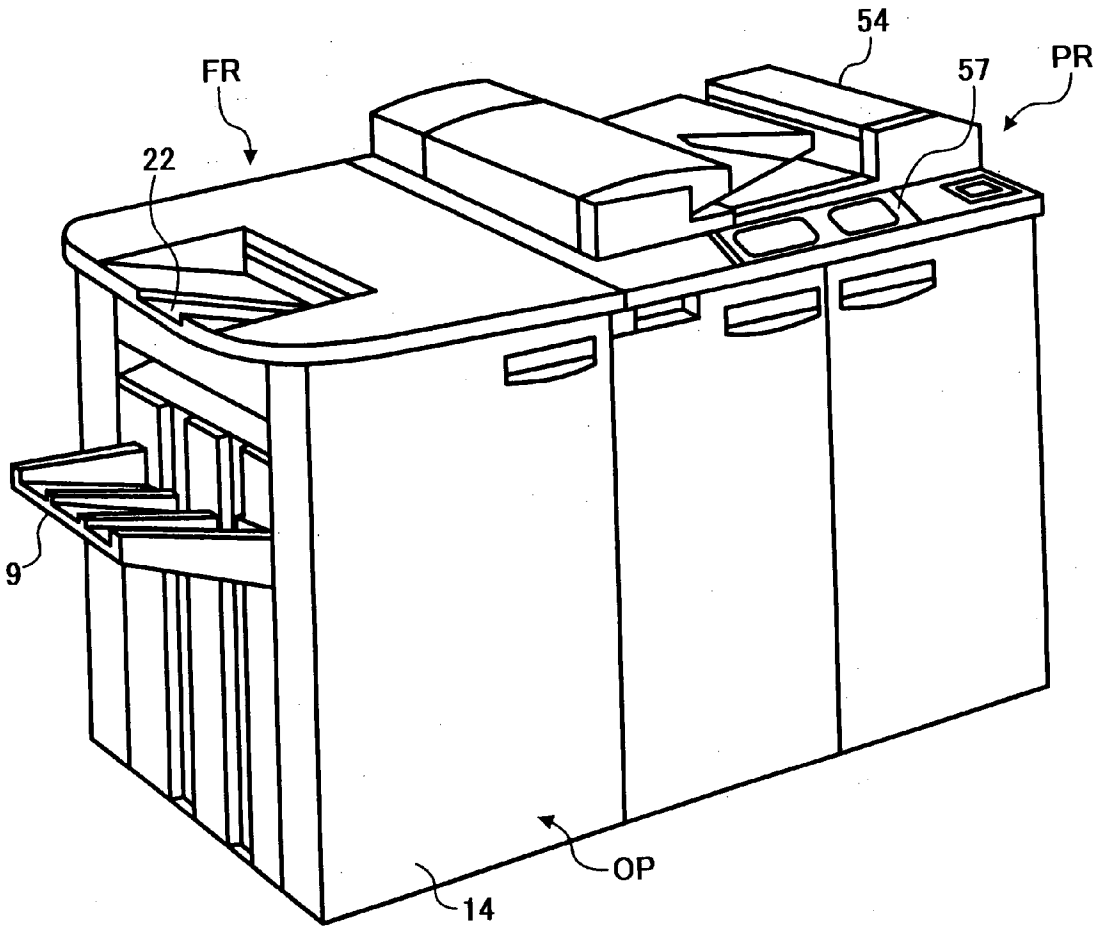
FIG. 1 is an isometric view showing an image forming system embodying the present invention and generally made up of an image forming apparatus and a sheet processing apparatus.
Figure 2:
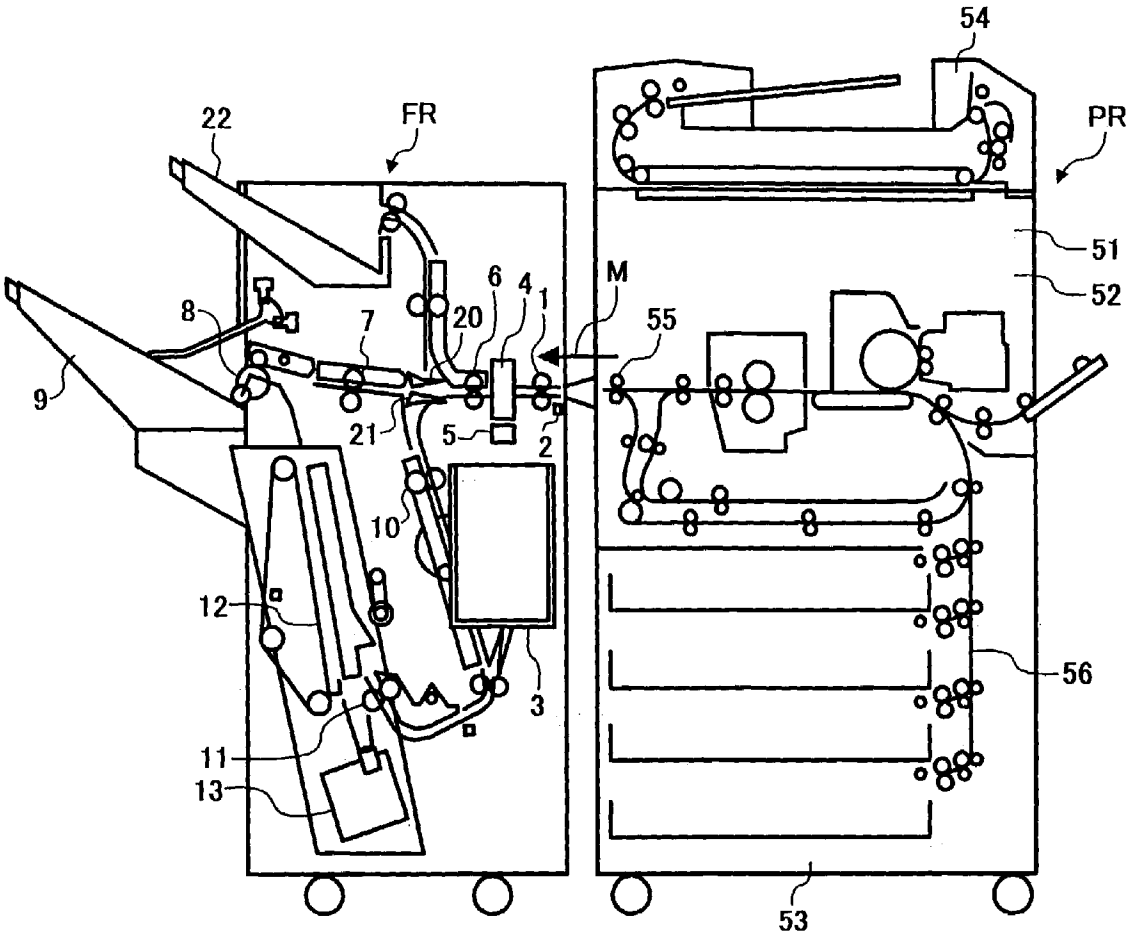
FIG. 2 is a view showing various devices arranged in the image forming system of FIG. 1.

Referring to FIG. 1 of the drawings, an image forming system embodying the present invention is shown. As shown, the image forming system is generally made up of an image forming apparatus (printer hereinafter) PR and a sheet finishing apparatus (sheet finisher hereinafter) FR. As shown in FIG. 2, the printer PR is selectively operable as a printer or a copier with an image reading section 51, an image writing section 52, a sheet feeding section 53 and a document feeding section 54. The printer PR may additionally be configured to operate as a facsimile apparatus or may even be implemented as a digital MFP (Multi Function Peripheral) having all of such different functions, as desired. While the printer PR and sheet finisher FR are shown as being separate from each other in FIG. 2, they may, of course, be constructed integrally with each other.

The image reading section 51, implemented as a conventional scanner, optically scans a document in the main scanning direction while being moved in the subscanning direction to thereby read the document. The sheet feeding section, or ADF (Automatic Document Feeder) as often referred to, 54 conveys the above document to a glass platen included in the image reading section 51. The image writing section 52 is constituted by conventional optics including a laser diode, a polygonal mirror and an f θ lens and optically writes a latent image representative of the document on the surface of a photoconductive element. The latent image thus formed on the photoconductive element is developed by toner and then transferred to a sheet or recording medium as a toner image. Subsequently, the toner image is fixed on the sheet by a fixing unit and then transferred to the sheet finisher FR by an outlet roller pair 55.

In the illustrative embodiment, the sheet feeding section 53 includes four sheet cassettes arranged one above the other. A vertical sheet path 56 adjoins the right side of the sheet cassettes, as viewed in FIG. 2, where sheets are expected to be paid out. A sheet paid out from any one of the sheet cassettes is conveyed to the image writing section 52 via the vertical sheet path 56.

The sheet, carrying the toner image thereon, is transferred from the printer PR to the sheet finisher FR in a direction indicated by an arrow M in FIG. 2. The sheet finisher FR includes an inlet roller pair 1 arranged to receive and convey the above sheet driven out of the printer PR. A punch unit 4 is positioned downstream of the inlet roller pair 1 in the direction of sheet conveyance in order to punch the sheet. A roller pair 6 for conveyance is positioned downstream of the punch unit 4 in the direction of sheet conveyance.

A conveying unit 5 is arranged beneath the punch unit 4 perpendicularly to the direction of sheet conveyance in order to convey chad produced from the sheet by the punch unit 4 to a hopper 3. More specifically, the conveying unit 5 conveys the chad toward an operation side OP, see FIG. 1, where the operator of the image forming system is expected to input desired processing meant for the sheet finisher FR or the printer PR on a control panel 57, see FIG. 1, replace toner or remove a jamming sheet. The hopper 3 is mounted on the inner surface of a front cover 14, see FIG. 1, which the operator opens to replace toner or deal with a jam. The front cover 14 forms part of the casing of the sheet finisher PR at the operation side OP.

A first and a second path selector 20 and 21, respectively, are located downstream of the roller pair 6 and cooperate to steer the sheet punched by the punch unit 4 toward a shift tray 9 via a sorting, stapling or similar processing station or simply steer it toward a proof tray 22.

More specifically, in the illustrative embodiment, a particular path is assigned to each of a sort mode, a staple mode and a proof mode. In the sort mode, the first and second path selectors 20 and 21 are respectively so positioned as to block a path terminating at the proof tray 22 and a path including a roller pair 10 while unblocking a path including a roller pair 7. As a result, the sheet is driven out to the shift tray 9, which has a shifting function, by an outlet roller pair 8 via the roller pair 7. The shifting function is assigned to the roller pair 7 capable of moving back and forth in the direction perpendicular to the direction of sheet conveyance volume by volume to thereby sort consecutive volumes on the shift tray 9. In this sense, the roller pair 7 will be referred to as a shift roller pair hereinafter.

In the staple mode, the second path selector 21 unblocks the path including the roller pair 10 and blocks the path terminating at the shift tray 9. At the same time, the first path selector 20 blocks the path terminating at the proof tray 22. In this condition, the sheet is routed through a staple roller pair 11 to a staple tray 12. Every time such a sheet is driven out to the staple tray 12 by the staple roller pair 11, a knock roller knocks down the sheet toward an end fence. Subsequently, jogger fences jog the edges of the sheet in the direction perpendicular to the direction of sheet conveyance. As soon as a preselected number of sheets, constituting a single volume, are sequentially stacked on the staple tray 12 in the manner described above, a stapler 13 staples the end portion of the sheet stack, i.e., the trailing end in the illustrative embodiment in the direction of sheet conveyance. Thereafter, a belt conveyor lifts the sheet stack thus stapled toward the outlet roller pair 8. As a result, the sheet stack is driven out to the shift tray 9 by the outlet roller pair 8.

Further, in the proof mode, the first path selector 20 is pivoted to unblock the path terminating at the proof tray 22, while blocking the path terminating at the shift tray 9. At the same time, the second path selector 21 blocks the path including the roller pair 10. As a result, the sheet being driven by the roller pair 6 is steered toward the proof tray 22.

As stated above, in the illustrative embodiment, the punch unit 4 and hopper 3 are positioned upstream of all sheet finishing stations. Basically, therefore, the punch unit 4 can punch any sheet introduced into the sheet finisher FR. Sheets thus punched may be simply stacked on the proof tray 22 or driven out to and sorted on the shift tray 9 or driven out to the shift tray 9 via the stapler 13.

While the printer PR of the illustrative embodiment is assumed to form an image corresponding to an image optically read by the image reading unit 51, the printer PR can, of course, form an image in accordance with image data directly received from a data processing apparatus or indirectly received via a network or even facsimile data. In the illustrative embodiment, the operation timing of the punch unit 4 and the operation timings of the first and second path selectors 20 and 21 are set in accordance with the timing at which an inlet sensor 2 senses the leading edge or the trailing edge of a sheet.

The paths included in the sheet finisher FR will be described more specifically with reference to FIGS. 3 through 5. As shown, an inlet path PS downstream of the punch unit 4, FIG. 2, branches into an upward or upper path PS1, a straight or middle path PS2 and a downward or lower path PS3. The upward path PS1 terminates at the proof tray 22, FIG. 2, while the straight path PS2 and downward path PS3 both terminate at the shift tray 9, FIG. 2. It should be noted that the three paths PS1 through PS3 branch off in three directions at the same position, implementing a three-way sheet conveyance.

Sheets that do not have to be finished are simply stacked on the proof gray 22. On the other hand, sheets, sorted by being shifted in the direction perpendicular to the direction of sheet conveyance volume by volume, are stacked on the shift tray 9. The shift tray 9 is moved up and down by a motor under the control of a control mechanism, although shown or described specifically.

The shift roller pair 7 and outlet roller pair 8 mentioned earlier are sequentially arranged on the straight path PS2 and configured to convey a sheet introduced into the path PS2 to the shift tray 9. The roller pair 10, staple roller pair 11 and staple unit 12 also mentioned earlier are sequentially arranged on the downstream path PS3.

The first path selector 20 selectively steers a sheet toward the proof tray 22 in the proof mode or steers it toward the shift tray 9 via the shift roller pair 7 in the shift mode. The second path selector 21 selectively steers the sheet toward the shift tray 9 via the shift roller pair 7 or steers it toward the staple tray 12 via the roller pair 11 in the staple mode.

Figure 3:
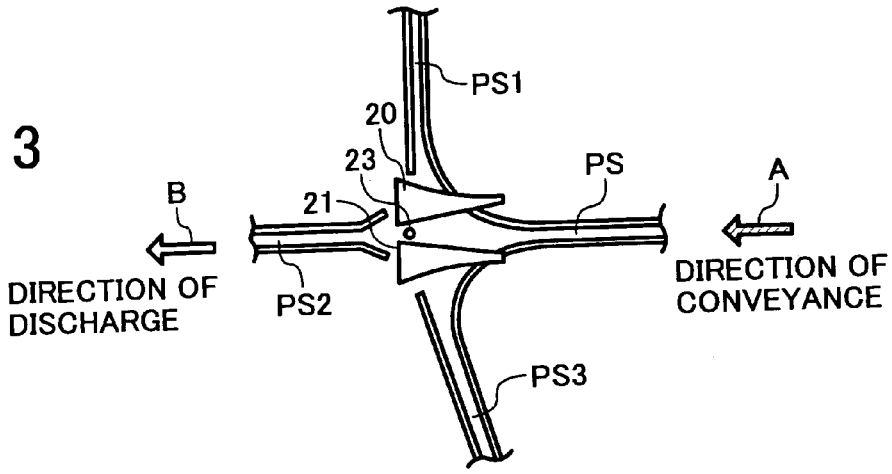
FIG. 3 is a fragmentary view showing path selectors unique to the illustrative embodiment in a shift mode condition.

More specifically, as shown in FIG. 3, in the shift mode, the two path selectors 20 and 21 are held in their initial positions for allowing a sheet to advance straight toward the shift roller 7 from a direction A to a direction B. At this instant, the, shift roller pair 7, preceding the outlet roller pair 8, is moved in the direction perpendicular to the direction of sheet conveyance to thereby shift the sheet in the above direction by a preselected amount.

Figure 4:
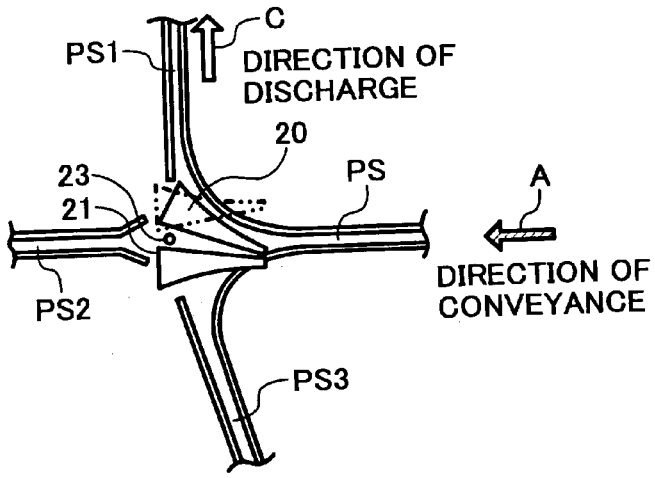
FIGS. 4 and 5 are views similar to FIG. 3, showing the path selectors in a proof mode condition and a staple mode condition, respectively.

As shown in FIG. 4, in the proof mode, the path selector 20 is caused to pivot on a fulcrum or shaft 23 clockwise to a position for steering a sheet, which is fed in the direction A, toward the proof tray 22 in a direction C.

Figure 5:
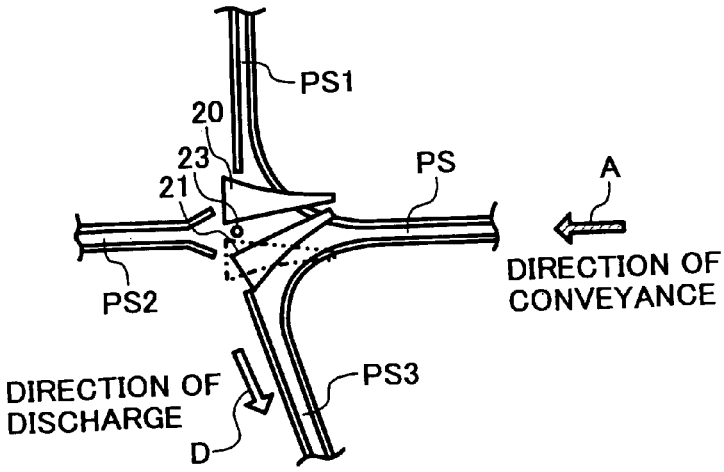

Further, as shown in FIG. 5, in the staple mode, the other path selector 21 is caused to pivot on the same fulcrum 23 counterclockwise to a position for steering the sheet fed in the direction A toward the staple tray 12 in a direction D.

Figure 6:
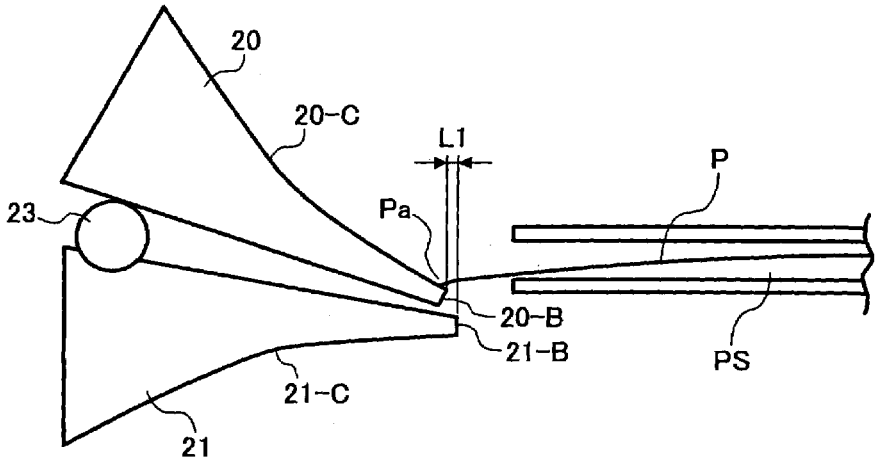
FIG. 6 is a view demonstrating the operation of the path selectors of the illustrative embodiment that share a single fulcrum.

FIG. 6 shows in an enlarged view the configuration of the two path selectors 20 and 21 unique to the illustrative embodiment in that they share the same fulcrum or axis of rotation 23. As shown, when the path selector 20, for example, is pivoted on the shaft 23 clockwise, the edge 20-B of the path selector 20 adjoins the edge 21-Bb of the path selector 21 at a distance L1. The distance L1 is small enough for the leading edge Pa of a sheet P, which is being conveyed along the path PS, to surely abut against a slant 20-C included in the path selector 20 even if the leading edge Pa is bent downward. The sheet P can therefore be surely steered upward by the above slant 20-C into the upward path PS1.

Figure 7:
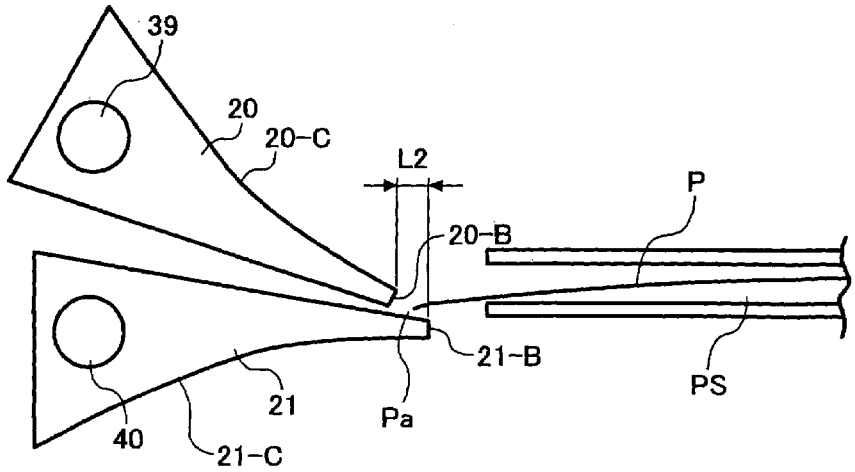
FIG. 7 is a view showing conventional path selectors each having a respective fulcrum.

By contrast, as shown in FIG. 7, assume that the path selectors 20 and 21 are positioned parallel to each other, but respectively pivotable on different fulcrums or shafts 39 and 40. Then, when the path selector 20, for example, is pivoted on the shaft 39 clockwise, a distance L2 between the locus of rotation of the leading edge 20-B of the path selector 20 and the locus of rotation of the leading edge 21-B of the path selector 21 is far greater than the distance L1 shown in FIG. 1. Consequently, if the leading edge Pa of the sheet P being conveyed along the path PS is bent downward, it fails to abut against the slant 20-C of the path selector 20, but abuts against the edge 20-B of the path selector 20 and brings about a jam.

On the other hand, as shown in FIG. 5, assume that the path selector 21, held in the position shown in FIG. 3, is pivoted on the shared fulcrum 23 counterclockwise in order to guide a sheet into the downward path PS3, as indicated by an arrow D. Then, the relation between the two path selectors 20 and 21 shown in FIG. 6 is inverted, i.e., the edge 21-B of the path selector adjoins the edge 20-B of the path selector 20 at the distance L1. It follows that the leading edge of the sheet can surely abut against the slant 21-C of the path selector 21 and can therefore be surely guided into the downward path PS3 thereby.

As stated above, in the illustrative embodiment, the first and second path selectors 20 and 21 share a single fulcrum or axis of rotation 23 positioned between them. This reduces positional deviation between the edges 20-B and 21-B of the path selectors 20 and 21, respectively, when the path selector 20 or 21 is pivoted on the shared fulcrum 23.

Hereinafter will be described a drive mechanism for operating the path selectors 20 and 21 and a slide mechanism for causing, by using the force of the drive mechanism, the shift roller pair 7 to slide in the direction perpendicular to the direction of sheet conveyance.

Figure 9:
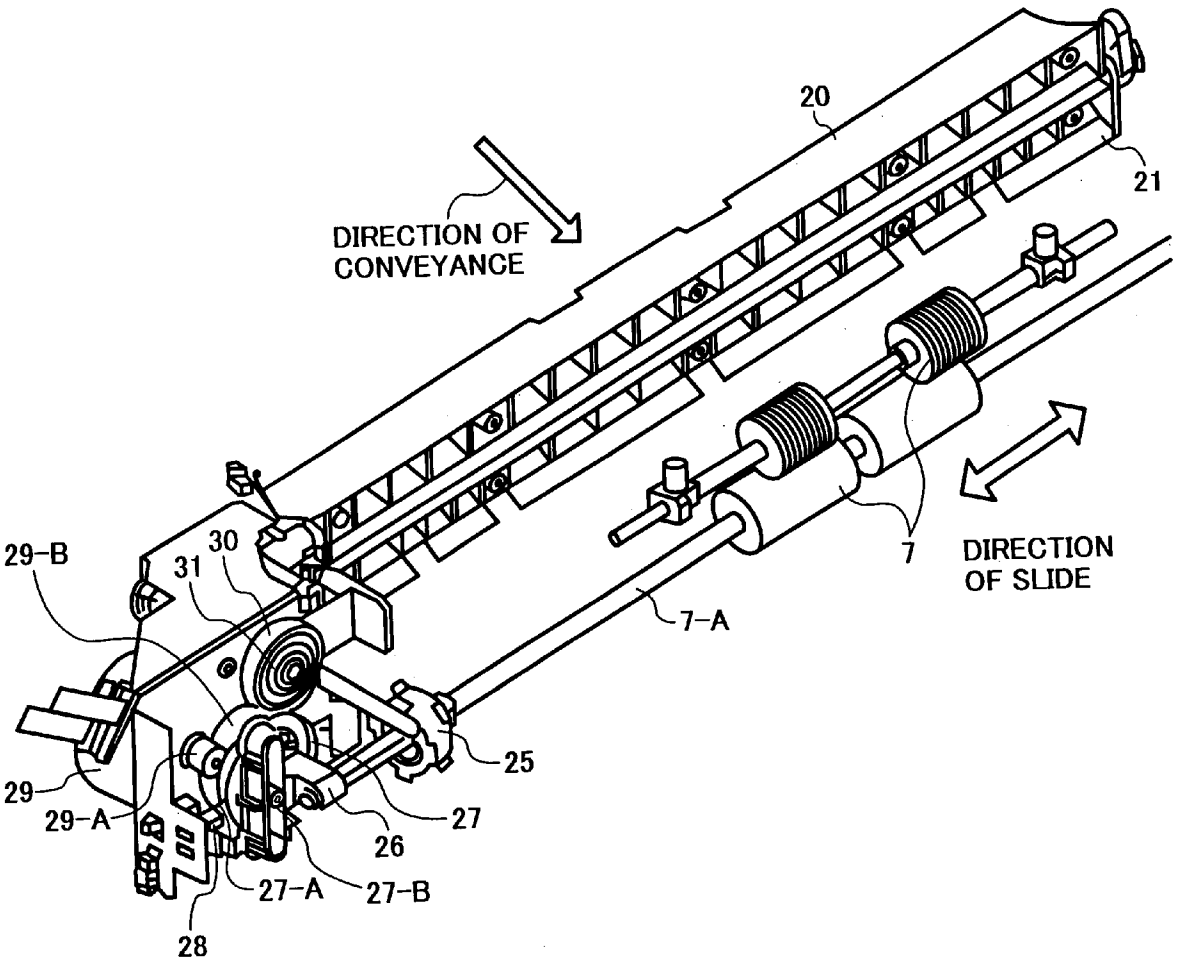
FIG. 9 is a perspective view showing arrangements for switching the path selectors of the illustrative embodiment and causing a shift roller pair to slide.

FIG. 9 shows the general configuration of the drive mechanism and slide mechanism mentioned above while FIG. 10 shows the drive mechanism in a fragmentary enlarged view. As shown, the shift roller pair 7 conveys a sheet, not shown, by being rotated by a pulley 25, which is, in turn, rotated by a stepping motor, not shown, via a timing belt. A shaft 7-A, supporting the shift rollers 7, and the pulley 25 are engaged with each other in such a manner as to rotate integrally with each other. More specifically, the engaging portions of the shaft 7-A and pulley 25 are generally D-shaped in cross section and abut against each other at the straight portion of letter D.

As shown in FIG. 9, a cam 27 and a link 26 cooperate to move the shaft or slide shaft 7-A and therefore the shift roller 7 mounted thereon back and forth in a direction indicated by a double-headed arrow. More specifically, when a stepping motor 29 is rotated in one direction, the output torque of the stepping motor 29 is transferred to the cam 27 via a drive gear 29-A and a driven gear 29-B meshing with each other, so that the cam 27 is caused to rotate. A pin or cam pin 27-B is studded on one axial end of the cam 27 and movably received in a slot 26-A formed in the link 26 perpendicularly to the axial direction of the slide shaft 7-A. In this configuration, when the cam 27 is rotated via the above gearing, the cam pin 27-B studded on the cam 27 is angularly moved with the result that the link 26 with the slot 26-A is moved back and forth in the direction perpendicular to the axial direction of the slide shaft 7-A. It is to be noted that the length of the slot 26-A is great enough to allow the cam pin 27-B to move in the up-and-down direction as viewed in FIG. 9.

The link 26 is integrally mounted on the slide shaft 7-A having a D-shaped cross-section mentioned earlier. Therefore, when the link 26 is linearly moved back and forth in accordance with the rotation of the cam 27, it causes the shift roller pair 7 to slide back and forth via the slide shaft 7-A in the direction indicated by the arrow in FIG. 9. To shift a sheet, the slide shaft 7-A, supporting the shift roller pair 7, is caused to slide in one direction when a sheet is passing through the shift roller pair 7, i.e., when a sheet is being nipped by a drive roller and a driven roller that constitute the shift roller pair 7. Subsequently, after the above sheet has moved away from the shift roller pair 7, but before the next sheet arrives at the roller pair 7, the shift roller pair 7 is caused to slide in the other direction in order to shift the next sheet in the same manner as it shifted the previous sheet.

In the illustrative embodiment, the sliding movement of the shift roller pair 7 stated above is implemented by the rotation of the stepping motor 29 effected in one direction. More specifically, the cam 27 geared to the stepping motor 29 causes the shift roller pair 7 to slide when rotated by 180° and then returns it when rotated by another 180°. Such control over the 180°—or half-rotation of the cam 27 is controlled on the basis of the number of drive pulses input to the stepping motor 29.

An HP (Home Position) sensor 28 is responsive to the home position of the cam 27, so that the angular position of the cam 27 is determined in accordance with the output of the HP sensor 28. More specifically, the cam 27 is determined to have reached its home position when an interrupter, protruding radially outward from the cam 27, interrupts the optical path of the HP sensor 28.

The shifting operation described above is effected volume by volume so as to sort consecutive sheets on the shift tray 9 while conveying the sheets. As for a volume, assume that ten volumes of identical booklets, for example, should be produced by copying or printing by a single job. Then, a single volume refers to each of ten volumes to be sequentially sorted on the shift tray 9.

Figure 11:
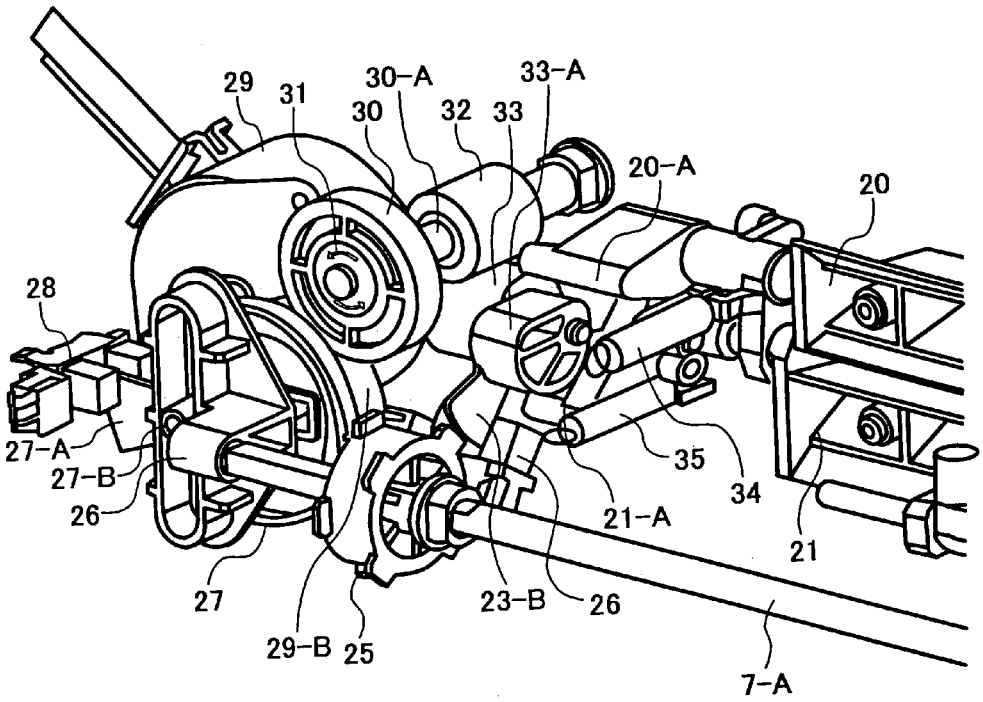
FIG. 11 is a fragmentary enlarged view of a path selector drive mechanism also included in the arrangements of FIG. 9.
Figure 12:
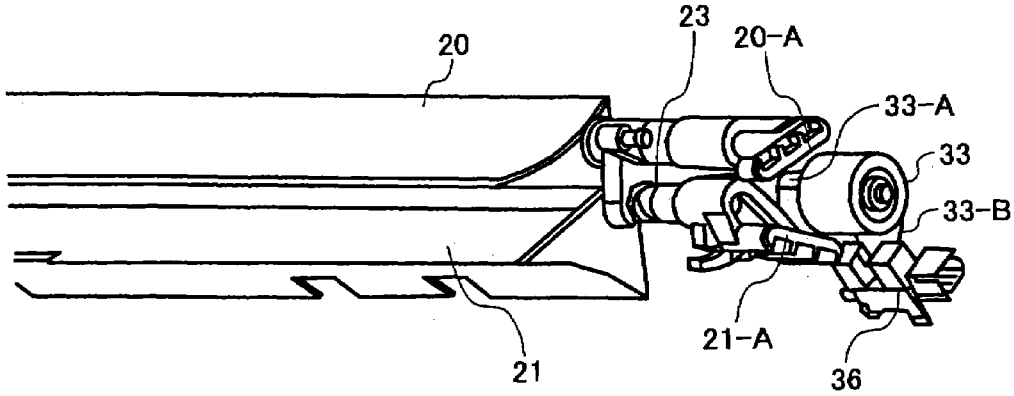
FIG. 12 is a fragmentary perspective view showing part of the drive mechanism of FIG. 11 associated with a pivot cam.

Reference will be made to FIGS. 11 and 12 for describing the drive mechanism for driving the path selectors 20 and 21 and also including the stepping motor 29. As shown, a gear 30 is operatively connected to the cam 27 via a one-way clutch 31 and held in mesh with the driven gear 29-B. The one-way clutch 31 is press-fitted in the gear 30 and so configured as to transfer the output torque of the stepping motor 29 to the gear 30 only when rotated in a preselected direction. More specifically, in the illustrative embodiment, the one-way clutch 31 transfers the output torque of the stepping motor 29 to the gear 30 when the stepping motor 29 is rotated in the direction (opposite direction hereinafter) opposite to the previously mentioned direction (one direction hereinafter) in which the motor 29 is rotated for driving the shift roller pair 7.

A worm 32 is fixedly mounted on a drive shaft that drives the gear 30. A worm wheel 33 is held in mesh with the worm 32 while a pivot cam 33-A is rotatable integrally, coaxially with the worm wheel 33. A spring, not shown, constantly biases the worm 32 toward the gear 30 in order to maintain the worm 32 in mesh with the worm wheel 33. As shown in FIG. 11, the pivot cam 33-A coaxial with the worm wheel 33 has a sectorial cross-section and selectively contacts either one of cam surfaces 20-A and 21-A included in the path selectors 20 and 21, respectively, thereby causing the path selector 20 or 21 to pivot in a preselected angular range. An interrupter 33-B is mounted on one end of the pivot cam 33-A. An HP sensor 36 determines that the pivot cam 33-A is in its home position on sensing the interrupter 33-B. The output of the HP sensor 36 is used to control the angular position of the pivot cam 33-A.

Figure 13:
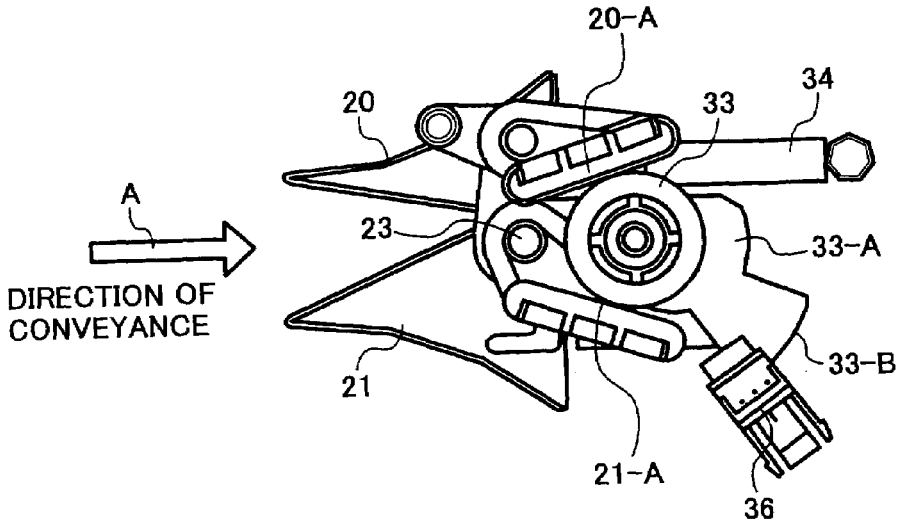
FIG. 13 is a front view showing the condition of the mechanism associated with the pivot cam.

FIG. 13 shows the path selectors 20 and 21, which basically move in the manner stated with reference to FIGS. 3 through 6, held in a default condition specifically. As shown, the cam surfaces 20-A and 21-A mentioned earlier are respectively positioned on one side face of the path selector 20 and one side surface of the path selector 21. In the default condition, the downstream ends of the cam surfaces 20-A and 21-A are open by the same angle as each other with respect to the direction of sheet conveyance indicated by an arrow in FIG. 13. The pivot cam 33-A is provided with a profile configured to selectively slide on the cam surface 20-A or 21-A for thereby angularly moving the path elector 20 or 21. The path selectors 20 and 21 are pivotable about the shared fulcrum or shaft 23, as stated previously.

In the general configuration of the drive mechanism described above, when the stepping motor 29 is rotated in the opposite direction mentioned earlier, the output torque of the stepping motor 29 is transferred to the gear 30 via the cam 27, causing the gear 30 to rotate together with the one-way clutch 31. At this instant, because the one-way clutch 31 is configured to act on a shaft over which it is coupled in a locking direction, the worm 32 rotates together with the shaft 30-A of the gear 30 to thereby cause the worm wheel 33 to rotate. As a result, the pivot cam 33-A rotatable integrally with the worm wheel 33 and the cam surface 20-A or 21-A of the path selector 20 or 21, respectively, contact each other, switching the position of the path selector 20 or 21, as will be described more specifically later.

As stated above, in the illustrative embodiment, the operation for switching the path selector 20 or 21 is effected when the one-way clutch 31 press-fitted in the gear 30 acts in the locking direction. On the other hand, the operation for moving the shift roller pair 7 back and forth in the axial direction of the slide shaft 7-A is effected when the one-way clutch 31 acts in the unlocking direction. It follows that the path selector switching operation is not effected when the shift roller sliding operation is under way. In the shift mode in which consecutive sheets are conveyed via the shift roller pair 7, the path selectors 20 and 21 are held in the default condition shown in FIG. 3 or 13 so as not to obstruct the conveyance. More specifically, as shown in FIG. 11, such a default condition is implemented by springs 34 and 35 constantly biasing the path selectors 20 and 21, respectively.

When the one-way clutch 31 acts in the locking direction, the path selector 20 or 21 is switched in position, as stated above. At this instant, the shift roller pair 7 is caused to slide at the same time because the cam 27 rotates integrally with the driven gear 29-B. However, so long as the path selector 20 or 21 is switched to a position shown in FIG. 16 or 14, respectively, a sheet can be successfully conveyed because it is prevented from reaching the shift roller pair 7 via the gap between the path selectors 20 and 21. If such a slide of the shift roller pair 7 is undesirable from a noise and vibration standpoint, then a one-way clutch, not shown, similar to the one-way clutch 31 assigned to the path selectors 20 and 21 may be mounted on the drive shaft of the driven gear 29-B and cam 27 and so configured as to interrupt drive transmission when the stepping motor 29 is rotated in the direction for driving the path selector 20 or 21.

Further, the one-way clutch assigned to the shifting operation makes it possible to reverse the rotation of the stepping motor 29 and therefore to start switching the path selector 20 or 21 only if the shifting operation has completed, i.e., even if a sheet has not moved away from the shift roller pair 7. This successfully enhances the productivity of the apparatus.

The operation for switching the path selectors 20 and 21 will be described more specifically hereinafter.

FIGS. 12 and 13 show the path selectors 20 and 21 in the default condition mentioned earlier. As shown, a preselected small gap exists between the pivot cam 33A and the cam surface 20-A of the first path selector 20 while the spring 35 maintains the second path selector 21 in the default position. Further, the interrupter 33-B movable integrally with the worm wheel 33 is held in the position where it interrupts the optical path of the HP sensor 36. Therefore, the default condition is set up in the shift mode for causing the path selectors 20 and 21 to guide a sheet toward the shift tray 9 via the shift roller pair 7.

Figure 14:
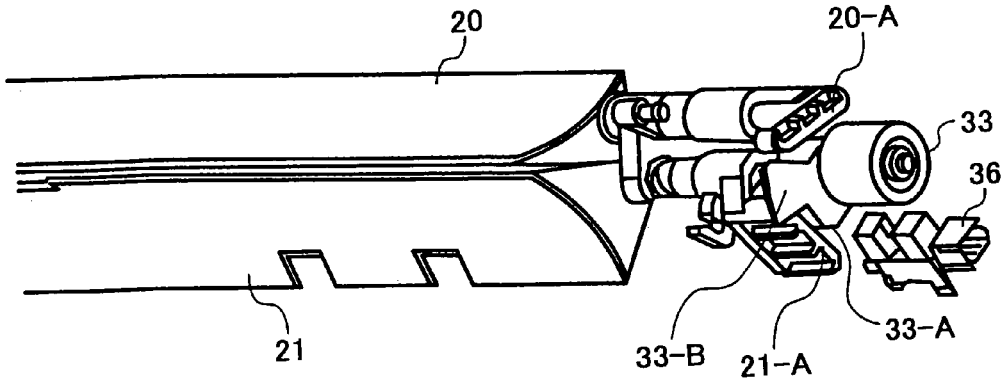
FIG. 14 is a view similar to FIG. 12, showing a condition for steering a sheet toward a staple tray.
Figure 15:
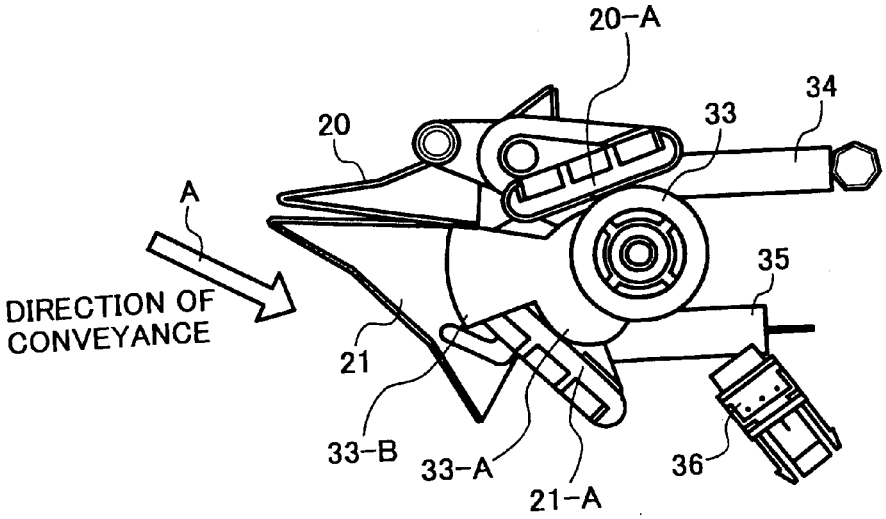
FIG. 15 is a front view showing the condition of FIG. 14.

Assume that the stepping motor 29 is rotated in the direction for switching the path selector 20 or 21 held in the default condition. Then, the pivot cam 33-A is rotated clockwise, as viewed in FIG. 13, via the drive transmission including the gears 29-B and 30, worm 32 and worm wheel 33. As a result, the pivot cam 33-A abuts against the cam surface 21-A of the path selector 21 and causes it pivot clockwise on the shaft 23, i.e., pushes it down. Therefore, the path selector 21 is also turned clockwise, as viewed in FIG. 13. FIGS. 14 and 15 show the resulting condition in which the path, terminating at the staple tray 12, is unblocked while the paths, terminating at the shift tray 9 and proof tray 29, respectively, are blocked. This condition corresponds to the condition shown in FIG. 5, i.e., the staple mode in which the path selector 21 steers a sheet toward the staple tray 12.

Figure 16:
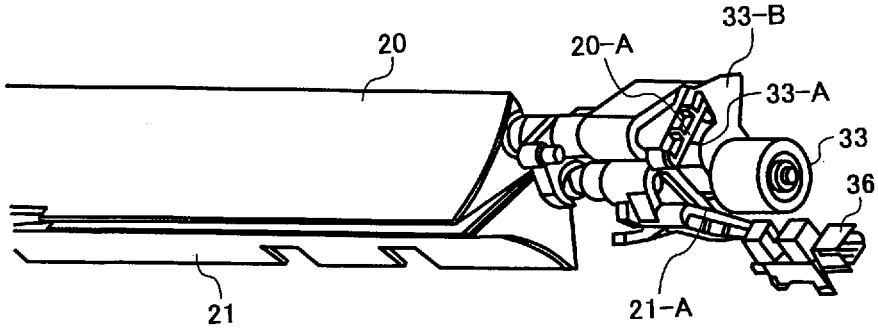
FIG. 16 is a view also similar to FIG. 12, showing a condition for steering a sheet toward a proof tray.
Figure 17:
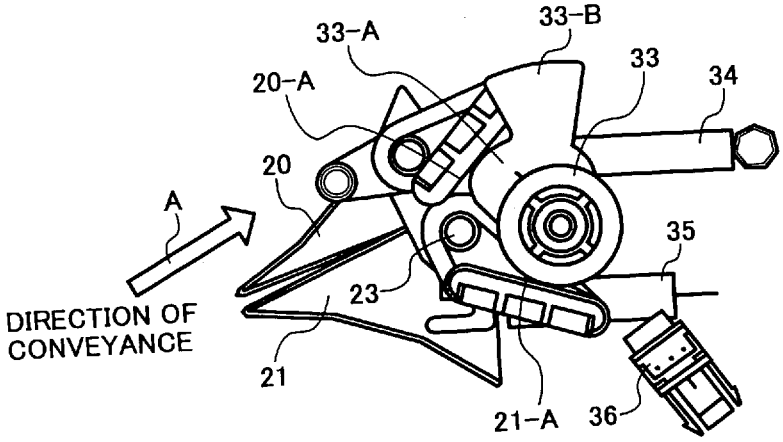
FIG. 17 is a front view showing the condition of FIG. 16.

Assume that the pivot cam 33-A is further rotated clockwise from the condition of FIGS. 14 and 15 in which the second path selector 21 is pivoted by the maximum angle. Then, the pivot cam 33-A leaves the dead point of the cam surface 21-A of the path selector 20 with the result that the cam surface 21-A starts turning counterclockwise about the shaft 23. Subsequently, the pivot cam 33-A starts contacting the cam surface 20-A of the first path selector 20 and causes the cam surface 20-A to turn counterclockwise about the shaft 23 in FIG. 15, i.e., pushes it up while leaving the cam surface 21-A itself. Consequently, the first path selector 20 is also caused to turn counterclockwise, as viewed in FIG. 15. FIGS. 16 and 17 show the resulting condition in which the path, terminating at the proof tray 29, is unblocked while the paths, respectively terminating at the shift tray 9 and staple tray 12, are blocked. This condition corresponds to the condition shown in FIG. 4, i.e., the proof mode in which the first path selector 20 steers a sheet toward the proof tray 29.

Subsequently, when the pivot cam 33-A is further rotated until it leaves the cam surface 20-A, the force of the pivot cam 20-A, acting on the first path selector 20, is canceled. As a result, the first and second path selectors 20 and 21 both are returned to their default positions by the action of the springs 34 and 35, respectively. Further, as soon as the interrupter 33-B of the pivot cam 33-A, rotating in the above direction, interrupts the optical path of the HP sensor 36, the stepping motor 29 is deenergized so as to restore the default condition shown in FIG. 13.

In the illustrative embodiment, the pivot cam 33-A is driven via the one-way clutch 31 and therefore rotatable in only one direction, as stated previously. It follows that to define the transition from the default condition of FIG. 13 to the staple mode condition of FIG. 16 or the proof mode condition of FIG. 17, the rotation of the stepping motor 29 is controlled on the basis of the profile of the pivot cam 33-A, the configuration and angle of each of the cam surfaces 20-A and 21-A, and the number of pulses counted from the home position sensed by the HP sensor 36.

Figure 8:
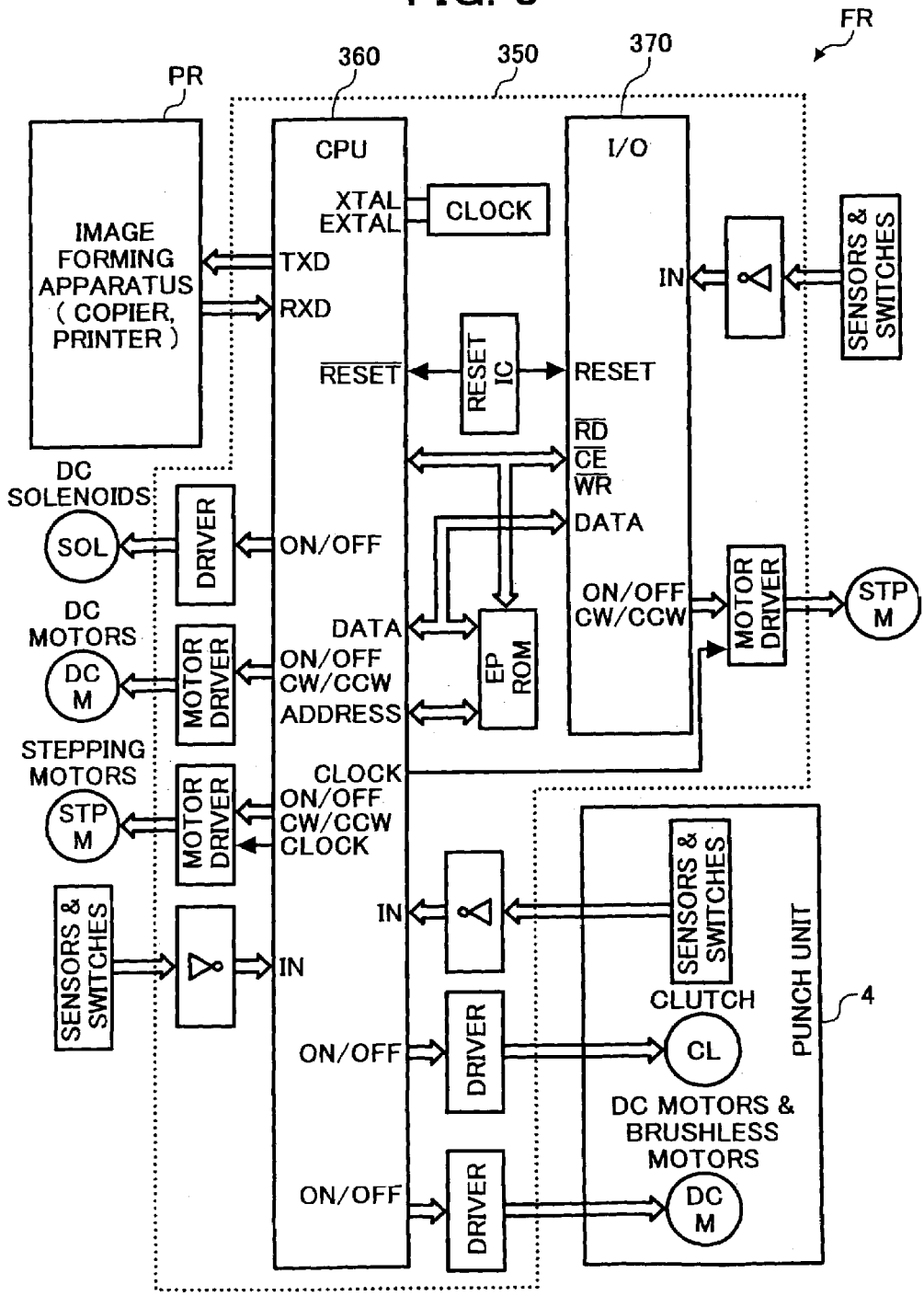
FIG. 8 is a schematic block diagram showing a control system included in the illustrative embodiment.

A control system included in the illustrative embodiment will be described with reference to FIG. 8. As shown, a controller or control unit 350 is implemented by a microcomputer including a CPU (Central Processing Unit) 360 and an I/O (Input/Output) interface 370. The CPU 360 receives via the I/O interface 370 the outputs of switches arranged on the control panel of the printer PR, the outputs of various sensors arranged in the sheet finisher FR and including the inlet sensor 2 and a discharge sensor, not shown, responsive to the level or height of the top sheet on the shift tray 9.

The CPU 360 controls, in accordance with the outputs of the above switches and sensors, various operations including the up-and-down movement of a punch included in the punch unit 4, the operation of the conveying unit 5, the jogging or positioning operation effected on the staple tray 12 perpendicularly to the direction of sheet conveyance, the stapling operation of the staple unit 13, the discharge of a stapled sheet stack, the up-and-down movement and shift of the shift tray 9, and the operation of the knock roller that knocks down a sheet toward the rear fence mentioned earlier. Further, the CPU 360 counts drive pulses input to a staple conveyance motor, not shown, for driving the staple roller pair 11 and controls the knock roller and jogging operation in accordance with the count of the drive pulses.

It is to be noted that the CPU 360 controls the sheet finisher FR by executing a program stored in a ROM (Read Only Memory), not shown, while using a RAM (Random Access Memory), not shown, as a work area.

A specific procedure for controlling the drive mechanism included in the illustrative embodiment will be described hereinafter with reference to FIGS. 18 and 19. The procedure to be described is executed by the CPU 360, FIG. 8, in accordance with a program stored in the ROM not shown. Alternatively, a program for executing the procedure may be downloaded from a server to an HDD (Hard Disk Drive) via a network or may be read out of a CD-ROM (Compact Disk ROM), SD (Secure Digital) memory card or similar recording medium by a medium drive, in which case version-up is available.

Figure 18:
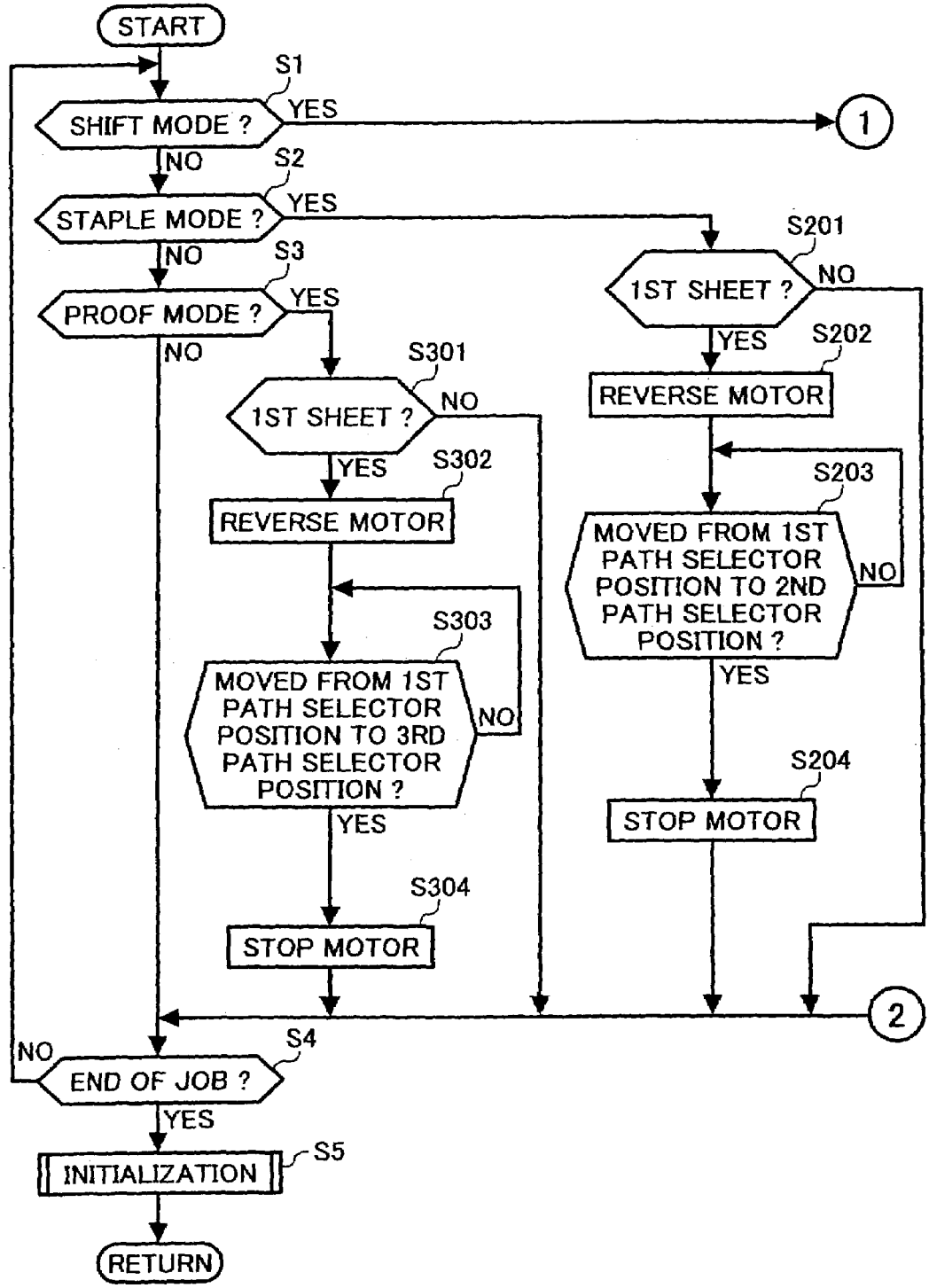
FIGS. 18 and 19 are flowcharts demonstrating a specific control procedure available with the illustrative embodiment.
Figure 19:
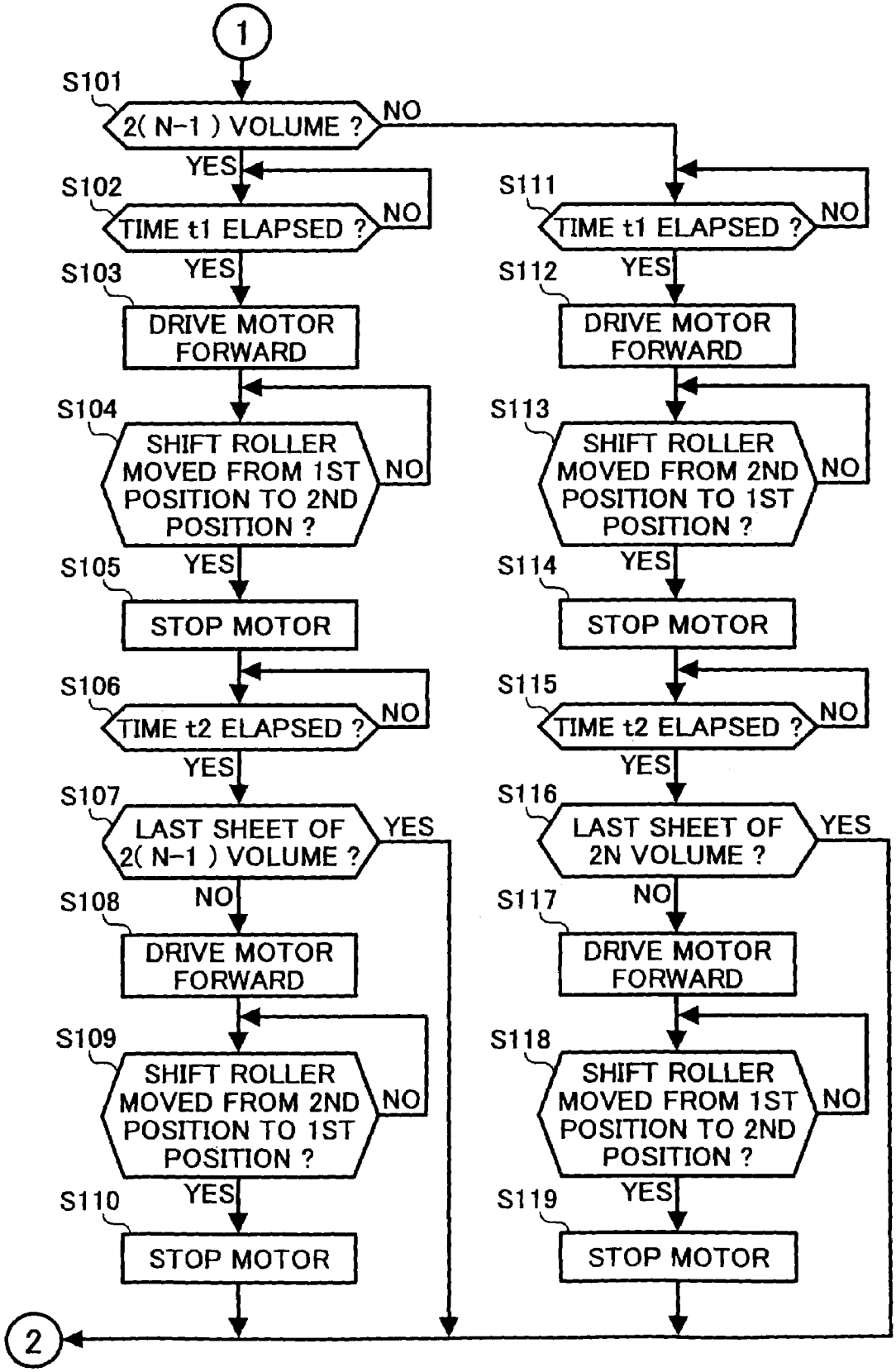

Briefly, as shown in FIGS. 18 and 19, the CPU 360 executes particular control in each of the shift mode (step S1), staple mode (step S2) and proof mode (step S3) and finally ends the procedure by performing an initialization subroutine (step S5).

More specifically, as shown in FIG. 18, the CPU 360 first determines whether or not the shift mode is selected (step S1). If the answer of the step Si is positive (Y), meaning that the shift mode is selected, then the first and second path selectors 20 and 21 are expected to be held in the default positions shown in FIGS. 12 and 13. Therefore, as shown in FIG. 3, the path, terminating at the shift tray 9, is blocked while the paths, respectively terminating at the staple tray 12 and proof tray 29, are blocked. In this case, the procedure is transferred from the step S1 to a step S101 shown in FIG. 19, as indicated by a connector ①.

In the step S101, to cause the shift roller pair 7 to shift consecutive sheets volume by volume, the CPU 360 determines whether or not a volume to deal with is an odd volume, i.e., a 2(N−1) volume. If the answer of the step S101 is Y, the CPU 360 determines whether or not the trailing edge of a sheet has moved away from the roller pair 6 to see if the sheet can be shifted or not. For this purpose, in the illustrative embodiment, the CPU 360 determines whether or not a preselected period of time t1 elapses from the time when the trailing edge of the sheet moves away from the inlet sensor 2 to the time when it moves away from the roller pair 6 (step S102). If the answer of the step S102 is Y, the CPU 360 causes the stepping motor 29 to rotate in the forward direction (step S103). It is to be noted that in the illustrative embodiment the forward direction refers to the direction for shifting the shift roller pair 7. The step S103 is followed by a step S104.

Figure 10:
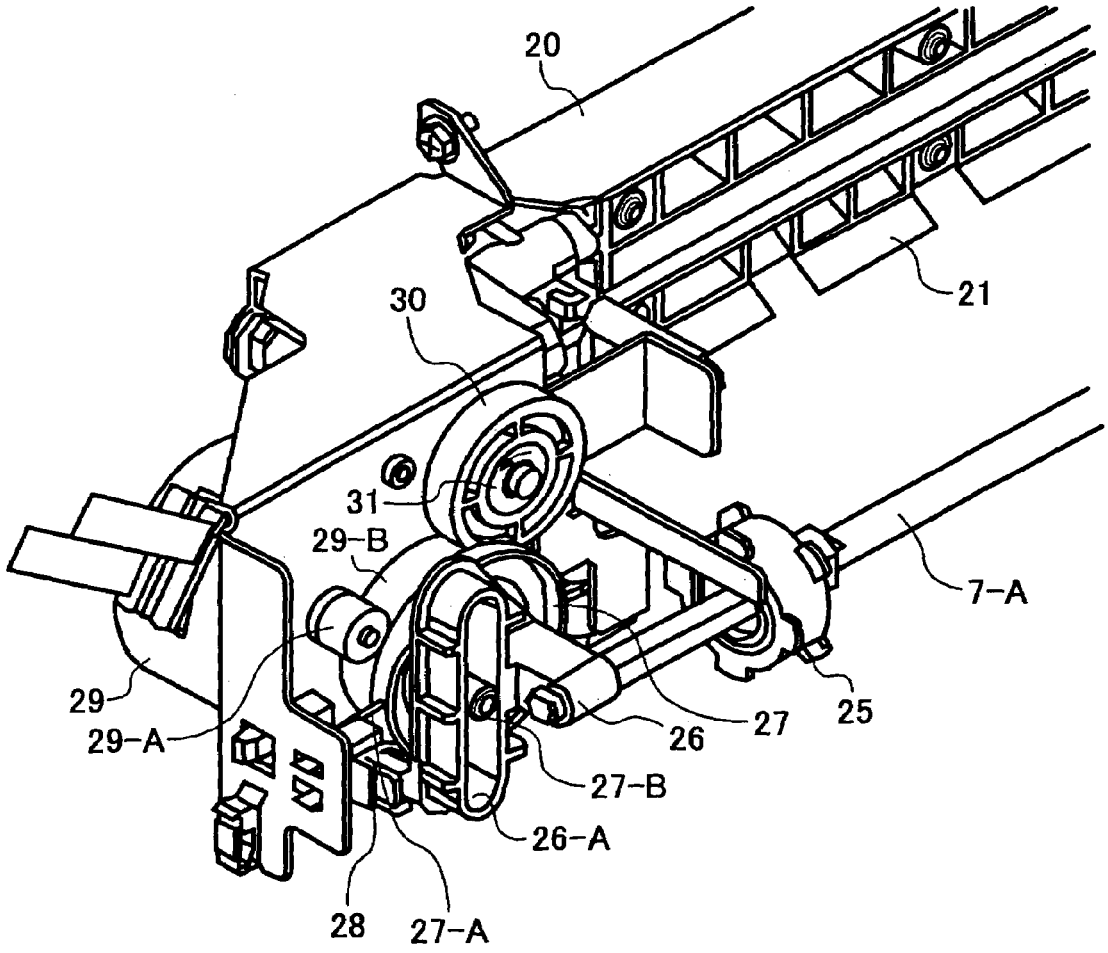
FIG. 10 is a fragmentary enlarged view of a drive section included in the arrangements of FIG. 9.

As for the step S104, assume that the shift roller pair 7 is movable between a first position or initial or leftmost position, as viewed in FIGS. 9 and 10, and a second position or rightmost position, and that in the first position the cam pin 27-B, FIGS. 9 and 10, is also positioned at the leftmost position while, in the second position set up when the cam 27 is rotated by 180° from the initial position, the cam pin 27-B is located at the rightmost position. Then, in the step S104, the CPU 360 determines whether or not the shift roller pair 7 has moved from the first position to the second position on the basis of the rotation angle of the cam 27 from the home position, i.e., the number of drive steps of the stepping motor 29.

If the answer of the step S104 is Y, meaning that the shift roller pair 7 has reached the second position, the CPU 360 deenergizes the stepping motor 29 (step S105). Subsequently, the CPU 360 determines whether or not a preselected period of time t2 elapses from the time when the trailing edge of the sheet moves away from the inlet sensor to the time when it moves away from the shift roller pair 7 (step S106), thereby determining whether or not the sheet has moved away from the shift roller pair 7. On the elapse of the period of time t2 (Y, step S106), the CPU 360 determines whether or not the sheet thus shifted is the last sheet of the odd or 2(N−1) volume (step S107). If the answer of the step S107 is Y, the procedure is transferred to the step S4, FIG. 18, as indicated by a connector 02.

If the answer of the step S107 is negative (N) the CPU 360 causes the stepping motor 29 to rotate in the forward direction to thereby return the shift roller pair 7 from the second position to the first stated mentioned earlier (step S108). The CPU 360 then determines whether or not the shift roller pair 7 has reached the first position (step S109) and then deenergizes, if the answer of the step S109 is Y, the stepping motor 29 (step S110). The step S110 is also followed by the step S4, FIG. 18.

In the step S4 following the step S107 or S110, FIG. 19, the CPU 360 determines whether or not the sheet shifted is the last sheet of the volume and the last sheet of the job at the same time, i.e., whether or not the job has ended. If the answer of the step S4 is Y, the CPU 360 ends the procedure after initialization (step S5). However, if the answer of the step S4 is N, meaning that the sheet shifted is not the last sheet of the job or the last sheet of the volume, the procedure returns to the step Si because the job has not ended.

The distance between the first and second positions of the shift roller pair 7 is two times as great as the distance between the cam pin 27-B and the center of the cam 27. In the illustrative embodiment, this distance is selected to be 15 mm although it can be freely selected at the design stage on the basis of the distance between the cam 27-B and the center of the cam 27.

On the other hand, if the answer of the step S101 is N, meaning that the volume to deal with is an even volume, the CPU 360 determines whether or not the preselected period of time t1 has elapsed as in the step S102 (step S111), thereby determining whether or not the trailing edge of the sheet has moved away from the roller pair 6. If the answer of the step S111 is Y, the CPU 360 causes the stepping motor 29 to rotate in the forward direction (step S112). At this instant, if the sheet being conveyed is the last sheet, as determined in the step S107, the shift roller pair 7 has been located at the second position in the step S104, so that the stepping motor 29 moves the cam pin 27-B and therefore the shift roller pair 7 from the second position to the first position. Therefore, the CPU 360 determines whether or not the shift roller 7 has returned from the second position to the first position (step S113) and then deenergizes, if the answer of the step S113 is Y, the stepping motor 29 (step S114).

After the step S114, the CPU 360 determines whether or not the preselected period of time t2 has elapsed as in the step S106 (step S115), thereby determining whether or not the trailing edge of the sheet has moved away from the shift roller pair 7. As a result, the sheet is shifted from the first position to the second position. At this instant, the amount of shift is 30 mm because the distance between the first and second positions is 15 mm, as stated earlier. Consequently, consecutive volumes are sequentially stacked on the shift tray 9 while being shifted from each other by 30 mm.

If the answer of the step S115 is Y, the CPU 360 determines whether or not the sheet shifted is the last sheet of the even volume or 2N volume (step S116). If the answer of the step S116 is Y, the procedure returns to the step S4, FIG. 18. If the answer of the step S116 is N, the CPU 360 causes the stepping motor 29 to rotate in the forward direction for thereby moving the shift roller pair 7 to the second position (step S117). The CPU 360 then determines whether or not the shift roller pair 7 has reached the second position (step S118) and then deenergizes, if the answer of the step S118 is Y, the stepping motor 29 (step S119). The step S119 is also followed by the step S4. In the step S4, the CPU 360 makes decision similar to the decision stated earlier in relation to the odd volume and then returns to the step S8 if the even volume has not been fully processed.

Referring again to FIG. 18, if the shift mode is not selected (N, step S1), the CPU 360 determines whether or not the staple mode is selected (step S2). If the answer of the step S2 is Y, the CPU 360 determines whether or not a sheet being conveyed is the first sheet to be dealt with in the staple mode (step S201). If the answer of the step S201 is Y, the CPU 360 causes the stepping motor 29 to rotate in the reverse direction in order to guide the sheet toward the staple tray 12 (step S202). As a result, the path selector 21 is angularly moved from the default position shown in FIGS. 12 and 13 (sometimes referred to as a first path selector position hereinafter) toward the position shown in FIGS. 14 and 15 (sometimes referred to as a second path selector position hereinafter). Subsequently, the CPU 360 determines whether or not the second path selector 21 has reached the second path selector position (step S203). If the answer of the step S203 is Y, the CPU 360 deenergizes the stepping motor 29 (step S204) and then waits for the entry of a sheet and the end of the job (step S4).

On the other hand, if the answer of the step S201 is N, meaning that the sheet being conveyed is the second or successive sheet, the CPU 360 simply waits for the entry of the sheet and the end of the job with the path selector 21 remaining in the second path selector position (step S4). On the end of the job, the CPU 360 executes the initialization (step S5) and then ends the procedure.

If the staple mode is not selected (N, step S2) the CPU 360 determines whether or not the proof mode is selected (step S3). If the answer of the step S3 is Y, the CPU 360 determines whether or not a sheet being conveyed is the first sheet to be dealt with in the proof mode (step S301). If the answer of the step S301 is Y, the CPU 360 causes the stepping motor 29 to rotate in the reverse direction in order to guide the sheet toward the proof tray 22 (step S302). As a result, the path selector 20 is angularly moved to the position shown in FIGS. 16 and 17 (sometimes referred to as a third path selector position hereinafter). Subsequently, the CPU 360 determines whether or not the path selector 20 has reached the third path selector position (step S303). If the answer of the step S303 is Y, the CPU 360 deenergizes the stepping motor 29 (step S304) and then waits for the entry of a sheet and the end of the job (step S4).

On the other hand, if the answer of the step S301 is N, meaning that the sheet being conveyed is the second or successive sheet, the CPU 360 simply waits for the entry of the sheet and the end of the job with the path selector 20 remaining in the third path selector position (step S4). On the end of the job, the CPU 360 executes the initialization (step S5) and then ends the procedure.

Figure 20:
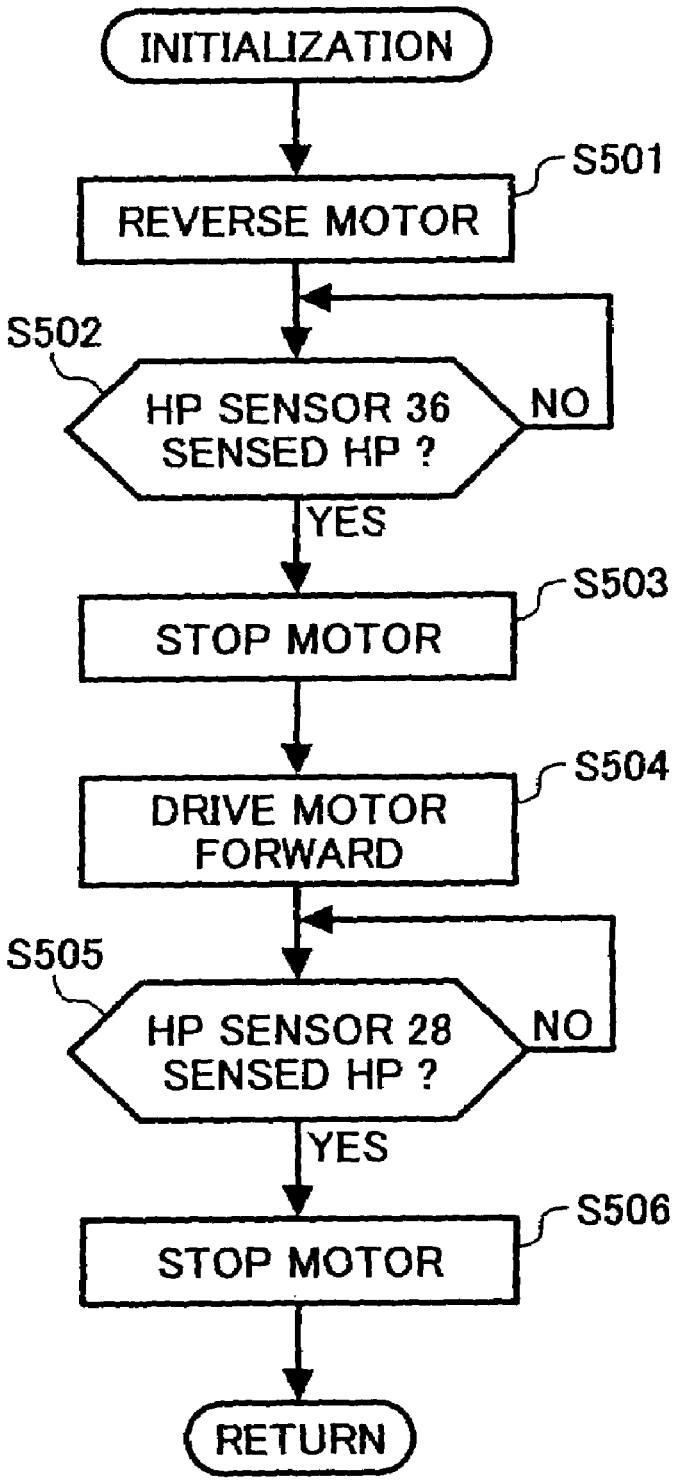
FIG. 20 is a flowchart showing an initialization subroutine included in the control procedure in detail.

FIG. 20 demonstrates the initialization subroutine executed in the step S5 in detail. As shown, the CPU 360 first causes the stepping motor 29 to rotate in the reverse direction (step S501) and then determines whether or not the HP sensor 36 has sensed the home position of the pivot cam 33-A (step S502). If the answer of the step S502 is Y, the CPU 360 deenergizes the stepping motor 29 (step S503) and then causes it to rotate in the forward direction (step S504). Subsequently, the CPU 360 determines whether or not the HP sensor 28 has sensed the home position of the pivot cam 27 (step S505). If the answer of the step S505 is Y, the CPU 360 deenergizes the stepping motor 29 (step S506). Consequently, the two path selectors 20 and 21, cams 33-A and 27 and shift roller pair 7 each are returned to the respective home position and prepared for the next operation thereby.

It should be noted that the position of the stepping motor 29 is indefinite in a power-down condition. Therefore, when the entire system is initialized in the event of power-up, the subroutine shown in FIG. 20 is also executed in order to bring the stepping motor 29 and cams 27 and 33-A to their default positions.

As stated above, in the illustrative embodiment, the stepping motor 29, which is a drive source assigned to the shift mechanism, is used to move the path selectors 20 and 21, but the one way-clutch 31 prevents the path selectors 20 and 21 from moving when the shifting operation is under way. When the edges of the path selectors 20 and 21 are spaced apart from each other, a sheet conveyed to the path selectors 20 and 21 is driven out to the shift tray 9 via the shift roller pair 7 and outlet roller pair 8.

Assume that the path selector 20 or 21 is angularly moved when the sheet, passing through the shift roller pair 7, is shifted in the direction perpendicular to the direction of conveyance. Then, it is likely that the leading edge of the next sheet is caught by the path selector 20 or 21 or that the edge of the path selector 20 or 21 contacts a sheet passing through the gap between the path selectors 20 and 21, resulting in a jam. The illustrative embodiment obviates this kind of jam by preventing the path selectors 20 and 21 from moving when the shifting operation is under way, as stated above, thereby insuring stable sheet conveyance.

Although the stepping motor 29 is shared by both of the shift mechanism and path selector switching mechanism, productivity in an interrupt mode is enhanced because when one mechanism is operating, the other mechanism does not operate.

In the illustrative embodiment, when a sheet is conveyed to the shift roller pair 7, the stepping motor 29, driving the shift roller pair 7, is rotated in the reverse direction just after the shift of the sheet so as to switch the path selector 20 or 21, thereby allowing the above sheet to be steered to another path. This unique arrangement is achievable because the shift roller pair 7 and path selectors 20 and 21 are driven by the forward and reverse rotation of a single motor and because such forward and reverse rotation effect the above drive independently of each other.

Controlling the path selector positions with the number of pulses from a home position, the illustrative embodiment can recognize a plurality of positions by use of a single home position sensor. In addition, using a motor for path selector switching in place of conventional DC solenoids, the illustrative embodiment is capable of moving the path selectors slowly with a minimum of noise.

Further, when one of the two path selectors is in movement, the other path selector is surely held in a halt. This prevents the path selectors from hitting against each other for thereby maintaining the switching operation stable.

Moreover, the two path selectors are shaped symmetrically to each other with respect to the fulcrum or shaft 23 while the pivot cam 33-A is positioned between the cam surfaces 20-A and 21-A of the path selectors. More specifically, the cam surfaces 20-A and 21-A are inclined toward the pivot cam 33-A while parting from each other and move the path selectors 20 and 21, respectively, in contact with the pivot cam 33-A. The cam surfaces 20-A and 21-A thus inclined relative to the cam 33-A exert a minimum of force on the cam 33-A.

In summary, it will be seen that the present invention provides a sheet conveying device in which a switching mechanism shares a single drive source with a shifting mechanism to thereby obviate the need for solenoids. The conveying device is therefore small size and low cost. Further, the shifting operation and switching operation can be performed independently of each other by using the reversible rotation of the drive source. This not only reduces the size and cost of the device, but also realizes sure control over sheet conveyance, e.g., three-way sheet conveyance and shift.

Various modifications will become possible for those skilled in the art after receiving the teachings of the present disclosure without departing from the scope thereof.

What is claimed is:

1. A sheet conveying device comprising:

conveying means for conveying a sheet;

switching means for switching a direction of conveyance of the sheet being conveyed by said sheet conveying means; and shifting means for shifting the sheet passed through said switching means and nipped by said conveying means in a direction perpendicular to the direction of conveyance;

wherein said switching means and said shifting means share a single drive source.

2. The device as claimed in claim 1, further comprising a drive transmitting mechanism configured to cause a switching operation of said switching means and a shifting operation of said shifting means to occur independently of each other.

3. The device as claimed in claim 2, wherein said drive transmitting mechanism prevents the switching operation and the shifting operation from overlapping each other.

4. The device as claimed in claim 2, wherein said drive source is rotatable in opposite directions, and said drive transmitting mechanism causes the shifting operation to occur when said drive source is rotated in one direction or causes the switching operation to occur when said drive source is rotated in the other direction.

5. The device as claimed in claim 4, wherein said drive transmitting mechanism comprises a shifting mechanism and a switching mechanism, and said switching mechanism includes a one-way clutch configured to transmit an output torque of said drive source only to said shifting mechanism when said drive source is rotated in the one direction.

6. The device as claimed in claim 5, wherein said shifting mechanism includes a one-way clutch configured to transmit, when said drive source is rotated in the one direction, an output torque of said drive source only to said shifting mechanism or interrupts, when said drive source is rotated in the other direction, drive transmission to said shifting mechanism while transmitting said output torque only to said switching mechanism.

7. The device as claimed in claim 1, wherein said switching means comprises a plurality of switching means positioned in parallel in such a manner as to sandwich a sheet conveyance plane and supported by a single fulcrum in such a manner as to be pivotable independently of each other.

8. The device as claimed in claim 7, wherein said switching means comprises a pair of path selectors each being supported by the single fulcrum at a respective lengthwise end portion.

9. The device as claimed in claim 8, wherein said pair of path selectors are formed with respective cam surfaces at lengthwise ends said drive transmitting mechanism includes a cam configured to selectively contact or part from either one of said cam surfaces for thereby causing said cam surface to pivot about the fulcrum, and said cam is rotated in one direction by the output torque of said drive source to thereby switch the direction of sheet conveyance.

10. The device as claimed in claim 9, wherein said cam surfaces each are configured such that a downstream side in the direction of sheet conveyance is open relative to a line connecting an axis of rotation of said cam and a center of a path configured to pass the sheet to a gap between said pair of path selectors.

11. The device as claimed in claim 10, wherein said cam surfaces are positioned symmetrically to each other with respect to said line in an initial condition.

12. The device as claimed in claim 1, further comprising control means for causing said switching means to select any one of three paths for sheet conveyance.

13. The device as claimed in claim 12, wherein said control means sets a particular drive direction and a particular drive stop position of said drive source in each of a shift mode, a staple mode and a proof mode.

14. The device as claimed in claim 13, wherein said drive source comprises a stepping motor, and said control means determines the drive stop position on the basis of a number of drive pulses input to said stepping motor.

15. The device as claimed in claim 14, further comprising a computer program including a procedure in which a computer executes a function of said control means.

16. The device as claimed in claim 15, further comprising a recording medium storing said computer program such that the computer is capable of reading out and executing said computer program.

17. A sheet processing apparatus comprising:

a sheet conveying device configured to convey a sheet; and sheet processing means for performing preselected processing with the sheet conveyed or to be conveyed by said sheet conveying device and then discharging said sheet;

said sheet conveying device comprising:

conveying means for conveying the sheet;

switching means for switching a direction of conveyance of the sheet being conveyed by said sheet conveying means; and shifting means for shifting the sheet passed through said switching means and nipped by said conveying means in a direction perpendicular to the direction of conveyance;

wherein said switching means and said shifting means share a single drive source.

18. An image forming apparatus comprising:

a sheet conveying device configured to convey a sheet; and image forming means for forming a toner image on the sheet conveyed or to be conveyed by said sheet conveying device;

said sheet conveying device comprising:

conveying means for conveying the sheet;

switching means for switching a direction of conveyance of the sheet being conveyed by said sheet conveying means; and shifting means for shifting the sheet passed through said switching means and nipped by said conveying means in a direction perpendicular to the direction of conveyance;

wherein said switching means and said shifting means share a single drive source.

19. In an image forming system in which a sheet processing apparatus for performing preselected processing with a sheet and then discharging said sheet and an image forming apparatus for forming a toner image on said sheet, said sheet processing apparatus comprising:

a sheet conveying device configured to convey the sheet; and sheet processing means for performing preselected processing with the sheet conveyed or to be conveyed by said sheet conveying device and then discharging said sheet;

said sheet conveying device comprising:

conveying means for conveying the sheet;

switching means for switching a direction of conveyance of the sheet being conveyed by said sheet conveying means; and shifting means for shifting the sheet passed through said switching means and nipped by said conveying means in a direction perpendicular to the direction of conveyance;

wherein said switching means and said shifting means share a single drive source.

20. A sheet processing method capable of dealing with a shift mode, a staple mode and a proof mode, said sheet processing method comprising:

a first step of determining which of the shift mode, the staple mode and the proof mode is selected;

a second step of rotating in a preselected direction, if the shift mode is selected, as determined in said first step, a motor configured to move a shift roller pair in a direction perpendicular to a direction of sheet conveyance by a preselected amount when said shift roller pair is conveying a sheet;

a third step of rotating, if the staple mode is selected, as determined in said first step, the motor in a direction opposite to the preselected direction for thereby actuating a switching mechanism configured to switch a path selector to a position for steering a sheet to a path that extends to a staple tray; and a fourth step of rotating, if the proof mode is selected, as determined in said first step, the motor in the direction opposite to the preselected direction for thereby actuating the switching mechanism configured to switch the path selector to a position for steering a sheet to a path that extends to a proof tray.

21. The method as claimed in claim 20, wherein said second step comprises repeating with a first sheet to a second-from-the-last sheet an operation for moving, by rotating the motor in a same direction when the switching mechanism is held in an initial condition without a driving force applied thereto, the shift roller pair from a first position to a second position after a trailing edge of the sheet has moved away from a roller pair just preceding the path selector and then returning said shift roller pair after said trailing edge of said sheet has moved away from said shift roller pair.

22. The method as claimed in claim 21, wherein if a last sheet of a volume is to be followed by another volume, said another volume is processed with said shift roller pair being held in the second position.

23. The method as claimed in claim 22, wherein a computer program, including a procedure that allows a computer to execute consecutive steps of said method, is used.

24. The method as claimed in claim 23, wherein a recording medium, storing the computer program such that a computer is capable of reading out and executing said computer program, is used.

25. A sheet conveying device comprising:

a sheet conveyor;

a switch for switching a direction of conveyance of the sheet being conveyed by said sheet conveyor; and a shifting device positioned for shifting the sheet passed through said switch and nipped by said sheet conveyor in a direction perpendicular to the direction of conveyance;

wherein said switch and said shifting device share a single drive source.

26. The device as claimed in claim 25, further comprising a drive transmitting mechanism configured to cause a switching operation of said switch and a shifting operation of said shifting device to occur independently of each other.

27. The device as claimed in claim 26, wherein said drive transmitting mechanism prevents the switching operation and the shifting operation from overlapping each other.

28. The device as claimed in claim 26, wherein said drive source is rotatable in opposite directions, and said drive transmitting mechanism causes the shifting operation to occur when said drive source is rotated in one direction or causes the switching operation to occur when said drive source is rotated in the other direction.

29. The device as claimed in claim 28, wherein said drive transmitting mechanism comprises a shifting mechanism and a switching mechanism, and said switching mechanism of said drive transmitting mechanism includes a one-way clutch configured to transmit an output torque of said drive source only to said shifting mechanism of said drive transmitting mechanism when said drive source is rotated in the one direction.

30. The device as claimed in claim 29, wherein said shifting mechanism of said drive transmitting mechanism includes a one-way clutch configured to transmit, when said drive source is rotated in the one direction, an output torque of said drive source only to said shifting mechanism of said drive transmitting mechanism or interrupts, when said drive source is rotated in the other direction, drive transmission to said shifting mechanism of said drive transmitting mechanism while transmitting said output torque only to said switching mechanism of said drive transmitting mechanism.

31. The device as claimed in claim 25, wherein said switch comprises a plurality of switches positioned in parallel in such a manner as to sandwich a sheet conveyance plane and supported by a single fulcrum in such a manner as to be pivotable independently of each other.

32. The device as claimed in claim 31, wherein said switch comprises a pair of path selectors, each being supported by the single fulcrum at a respective lengthwise end portion.

33. The device as claimed in claim 32, wherein said pair of path selectors are formed with respective cam surfaces at lengthwise ends said drive transmitting mechanism includes a cam configured to selectively contact or part from either one of said cam surfaces for thereby causing said cam surface to pivot about the fulcrum, and said cam is rotated in one direction by the output torque of said drive source to thereby switch the direction of sheet conveyance.

34. The device as claimed in claim 33, wherein said cam surfaces each are configured such that a downstream side in the direction of sheet conveyance is open relative to a line connecting an axis of rotation of said cam and a center of a path configured to pass the sheet to a gap between said pair of path selectors.

35. The device as claimed in claim 34, wherein said cam surfaces are positioned symmetrically to each other with respect to said line in an initial condition.

36. The device as claimed in claim 25, further comprising a controller adapted to cause said switch to select any one of three paths for sheet conveyance.

37. The device as claimed in claim 36, wherein said controller sets a particular drive direction and a particular drive stop position of said drive source in each of a shift mode, a staple mode and a proof mode.

38. The device as claimed in claim 37, wherein said drive source comprises a stepping motor, and said controller determines the drive stop position on the basis of a number of drive pulses input to said stepping motor.

39. The device as claimed in claim 38, further comprising a computer program including a procedure in which a computer executes a function of said controller.

40. The device as claimed in claim 39, further comprising a recording medium storing said computer program such that the computer is capable of reading out and executing said computer program.

41. A sheet processing apparatus comprising:

a sheet conveying device configured to convey a sheet; and sheet processor adapted to perform preselected processing with the sheet conveyed or to be conveyed by said sheet conveying device and then discharge said sheet;

said sheet conveying device comprising:

a conveyor for conveying the sheet;

a switching for switching a direction of conveyance of the sheet being conveyed by said sheet conveyor; and a shifting device for shifting the sheet passed through said switch and nipped by said conveyor in a direction perpendicular to the direction of conveyance;

wherein said switch and said shifting device share a single drive source.

42. An image forming apparatus comprising:

a sheet conveying device configured to convey a sheet; and image forming device adapted for forming a toner image on the sheet conveyed or to be conveyed by said sheet conveying device;

said sheet conveying device comprising:

a conveyor for conveying the sheet;

a switch switching a direction of conveyance of the sheet being conveyed by said sheet conveyor; and a shifting device adapted to shift the sheet passed through said switch and nipped by said conveyor in a direction perpendicular to the direction of conveyance;

wherein said switch and said shifting device share a single drive source.

43. In an image forming system in which a sheet processing apparatus for performing preselected processing with a sheet and then discharging said sheet and an image forming apparatus for forming a toner image on said sheet, said sheet processing apparatus comprising:

a sheet conveying device configured to convey the sheet; and a sheet processing device adapted to perform preselected processing with the sheet conveyed or to be conveyed by said sheet conveying device and then discharge said sheet;

said sheet conveying device comprising:

a conveyor for conveying the sheet;

a switch for switching a direction of conveyance of the sheet being conveyed by said conveyor; and a shifting device adapted to shift the sheet passed through said switch and nipped by said conveyor in a direction perpendicular to the direction of conveyance;

wherein said switch and said shifting device share a single drive source.

* * * * *